US007028725B2

(12) United States Patent
Hooker

(10) Patent No.: US 7,028,725 B2
(45) Date of Patent: Apr. 18, 2006

(54) METHOD AND APPARATUS FOR DISPENSING ICE AND WATER

(75) Inventor: John Kenneth Hooker, Louisville, KY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/749,032

(22) Filed: Dec. 30, 2003

(65) Prior Publication Data

US 2005/0138951 A1 Jun. 30, 2005

(51) Int. Cl.
*B65B 57/002* (2006.01)

(52) U.S. Cl. ..... 141/141; 141/360; 222/1; 222/52; 251/129.04

(58) Field of Classification Search ..... 222/63–66, 222/129, 1, 52, 76; 141/94, 198, 141, 360; 209/934; 251/129.04; 250/345
See application file for complete search history.

(56) References Cited

U.S. PATENT DOCUMENTS

| | | | | | |
|---|---|---|---|---|---|
| 3,089,594 | A | * | 5/1963 | Early | 209/525 |
| 3,319,761 | A | * | 5/1967 | Aiken et al. | 198/398 |
| 3,576,277 | A | * | 4/1971 | Blackman | 222/1 |
| 4,213,042 | A | * | 7/1980 | Beach et al. | 250/223 B |
| 4,293,219 | A | * | 10/1981 | Ducloux | 356/239.4 |
| 4,469,150 | A | * | 9/1984 | Grimaldi | 141/95 |
| 4,944,335 | A | * | 7/1990 | Stembridge et al. | 141/95 |
| RE33,435 | E | * | 11/1990 | Koblasz et al. | 141/1 |
| 6,286,324 | B1 | | 9/2001 | Pastryk et al. | |
| 6,314,745 | B1 | | 11/2001 | Janke et al. | |
| 6,351,958 | B1 | | 3/2002 | Pastryk et al. | |
| 6,688,134 | B1 | | 2/2004 | Barton et al. | |

* cited by examiner

*Primary Examiner*—Michael Mar
*Assistant Examiner*—Melvin A. Cartagena
(74) *Attorney, Agent, or Firm*—H. Neil Houser, Esq.; Armstrong Teasdale LLP

(57) ABSTRACT

A method for actuating a dispensing system, wherein the system includes a dispenser cavity and a dispenser is provided. The method includes intersecting at least two beams of light, sensing the at least two beams of light, and actuating the dispenser system based upon the sensing

16 Claims, 6 Drawing Sheets

METHOD AND APPARATUS FOR DISPENSING ICE AND WATER

BACKGROUND OF THE INVENTION

This invention relates generally to dispensing systems for appliances, and more particularly, to a water and ice dispensing system for a refrigerator.

Some known appliances that include ice makers and beverage dispensers, have dispensing systems that dispense ice and/or a liquid upon actuating a biased "cow tongue" lever. This requires the user to make contact with the lever and exert substantial force to overcome the biasing mechanism. Young and old users may have difficulty overcoming the force necessary to actuate the lever. Additionally, repeated contact with the lever facilitates unsanitary conditions.

BRIEF DESCRIPTION OF THE INVENTION

In one aspect, a method for actuating a dispensing system, wherein the system includes a dispenser cavity and a dispenser is provided. The method includes intersecting at least two beams of light, sensing the at least two beams of light, and actuating the dispenser system based upon the sensing.

In another aspect, an optical system for a dispenser system is provided. The system includes at least two light emitting optic elements mounted on opposing first and second dispenser walls, and at least two light receiving optic elements mounted on the opposing first and second dispenser walls, wherein each of the at least two light receiving optic elements is in optical communication with each of the at least two light emitting optic elements, and wherein the at least two light receiving optic elements are in electromechanical communication with the dispenser system.

In another aspect, a dispenser system is provide that includes a top wall, a bottom wall, and a cavity extending therebetween, wherein the top wall is parallel the bottom wall, a first wall, a second wall, and a third wall positioned therebetween, the second wall opposite the first wall, the third wall substantially perpendicular to both the first and second walls, the first, second, and third walls substantially perpendicular to both the top wall and the bottom wall. The system further includes at least one dispenser coupled to the third wall and an optical system coupled to the first and said second wall and in electromechanical communication with the at least one dispenser.

In another aspect, a refrigerator is provided that includes a fresh food compartment, a freezer compartment separated from the fresh food compartment by a mullion, a door movably positioned to cover the freezer compartment when in a closed position, a water supply in flow communication with at least one of an ice maker positioned within the freezer compartment coupled to the water supply, and a through the door water and ice dispenser coupled to the water supply and the ice maker. The refrigerator further includes an optical system operationally coupled to the dispenser, wherein the optical system is configured to transmit a plurality of infrared (IR) pulses from at least two IR light emitting diodes (LED), receive a plurality of IR pulses from the at least two IR LEDs, and actuate the dispenser to allow water and/or ice to flow therethrough upon sensing a container within the dispenser.

DETAILED DESCRIPTION OF THE INVENTION

Figure 1:
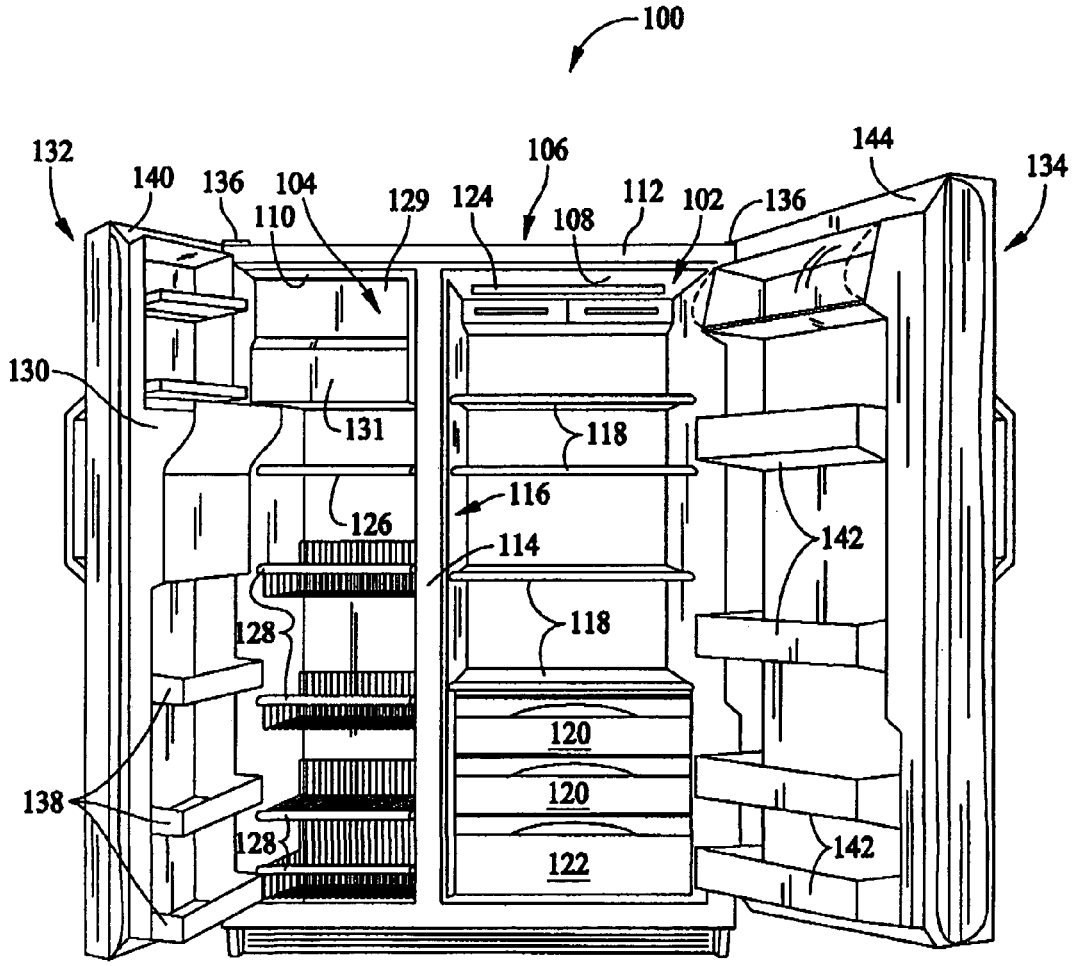
FIG. 1 illustrates a side-by-side refrigerator.

FIG. 1 is a perspective view of an exemplary refrigerator 100 in which exemplary embodiments of the present invention may be practiced and for which the benefits of the invention may be realized. It is appreciated, however, that the herein described methods and apparatus may likewise be practiced in a variety of liquid and ice dispensing appliance with modification apparent to those in the art. Therefore, refrigerator 100 as described and illustrated herein is for illustrative purposes only and is not intended to limit the herein described methods and apparatus in any aspect.

FIG. 1 illustrates a side-by-side refrigerator 100 including a fresh food storage compartment 102 and a freezer storage compartment 104. Freezer compartment 104 and fresh food compartment 102 are arranged side-by-side. In one embodiment, refrigerator 100 is a commercially available refrigerator from General Electric Company, Appliance Park, Louisville, Ky. 40225, and is modified to incorporate the herein described methods and apparatus.

It is contemplated, however, that the teaching of the description set forth below is applicable to other types of refrigeration with dispensing appliances, including but not limited to top and bottom mount refrigerators. The herein described methods and apparatus are therefore not intended to be limited to any particular type or configuration of a refrigerator, such as refrigerator 100.

Fresh food storage compartment 102 and freezer storage compartment 104 are contained within an outer case 106 and inner liners 108 and 110. A space between case 106 and liners 108 and 110, and between liners 108 and 110, is filled with foamed-in-place insulation. Outer case 106 normally is formed by folding a sheet of a suitable material, such as pre-painted steel, into an inverted U-shape to form top and side walls of case. A bottom wall of case 106 normally is formed separately and attached to the case side walls and to a bottom frame that provides support for refrigerator 100. Inner liners 108 and 110 are molded from a suitable plastic material to form freezer compartment 104 and fresh food compartment 102, respectively. Alternatively, liners 108, 110 may be formed by bending and welding a sheet of a suitable metal, such as steel. The illustrative embodiment includes two separate liners 108, 110 as it is a relatively large capacity unit and separate liners add strength and are easier to maintain within manufacturing tolerances. In smaller refrigerators, a single liner is formed and a mullion spans between opposite sides of the liner to divide it into a freezer compartment and a fresh food compartment.

A breaker strip 112 extends between a case front flange and outer front edges of liners. Breaker strip 112 is formed from a suitable resilient material, such as an extruded acrylo-butadiene-styrene based material (commonly referred to as ABS).

The insulation in the space between liners 108, 110 is covered by another strip of suitable resilient material, which also commonly is referred to as a mullion 114. Mullion 114 also preferably is formed of an extruded ABS material. Breaker strip 112 and mullion 114 form a front face, and extend completely around inner peripheral edges of case 106 and vertically between liners 108, 110. Mullion 114, insulation between compartments, and a spaced wall of liners separating compartments, sometimes are collectively referred to herein as a center mullion wall 116.

Shelves 118 and slide-out drawers 120 normally are provided in fresh food compartment 102 to support items being stored therein. A bottom drawer or pan 122 may partly form a quick chill and thaw system (not shown) and selectively controlled, together with other refrigerator features, by a microprocessor (not shown) according to user preference via manipulation of a control interface 124 mounted in an upper region of fresh food storage compartment 102 and coupled to the microprocessor. A shelf 126 and wire baskets 128 are also provided in freezer compartment 104.

Microprocessor is programmed to perform functions described herein, and as used herein, the term microprocessor is not limited to just those integrated circuits referred to in the art as microprocessor, but broadly refers to computers, processors, microcontrollers, microcomputers, programmable logic controllers, application specific integrated circuits, and other programmable circuits, and these terms are used interchangeably herein.

Freezer compartment 104 includes an automatic ice maker 129 and a through the door water and ice dispenser 130 is provided in freezer door 132. Ice maker 129 includes an ice bucket 131 for storage of ice. As will become evident below, dispenser 130 includes a number of electromechanical elements that dispense water and ice without opening freezer door 132. Periodically, ice maker 129 replenishes the ice supply as ice is dispensed from ice bucket 131.

Freezer door 132 and a fresh food door 134 close access openings to fresh food and freezer compartments 102, 104, respectively. Each door 132, 134 is mounted by a top hinge 136 and a bottom hinge (not shown) to rotate about its outer vertical edge between an open position, as shown in FIG. 1, and a closed position (not shown) closing the associated storage compartment. Freezer door 132 includes a plurality of storage shelves 138 and a sealing gasket 140, and fresh food door 134 also includes a plurality of storage shelves 142 and a sealing gasket 144.

In accordance with known refrigerators, refrigerator 100 also includes a machinery compartment (not shown) that at least partially contains components for executing a known vapor compression cycle for cooling air. The components include a compressor (not shown), a condenser (not shown), an expansion device (not shown), and an evaporator (not shown) connected in series and charged with a refrigerant. The evaporator is a type of heat exchanger which transfers heat from air passing over the evaporator to a refrigerant flowing through the evaporator, thereby causing the refrigerant to vaporize. The cooled air is used to refrigerate one or more refrigerator or freezer compartments via fans (not shown). Collectively, the vapor compression cycle components in a refrigeration circuit, associated fans, and associated compartments are referred to herein as a sealed system. The construction of the sealed system is well known and therefore not described in detail herein, and the sealed system is operable to force cold air through the refrigerator.

Figure 2:
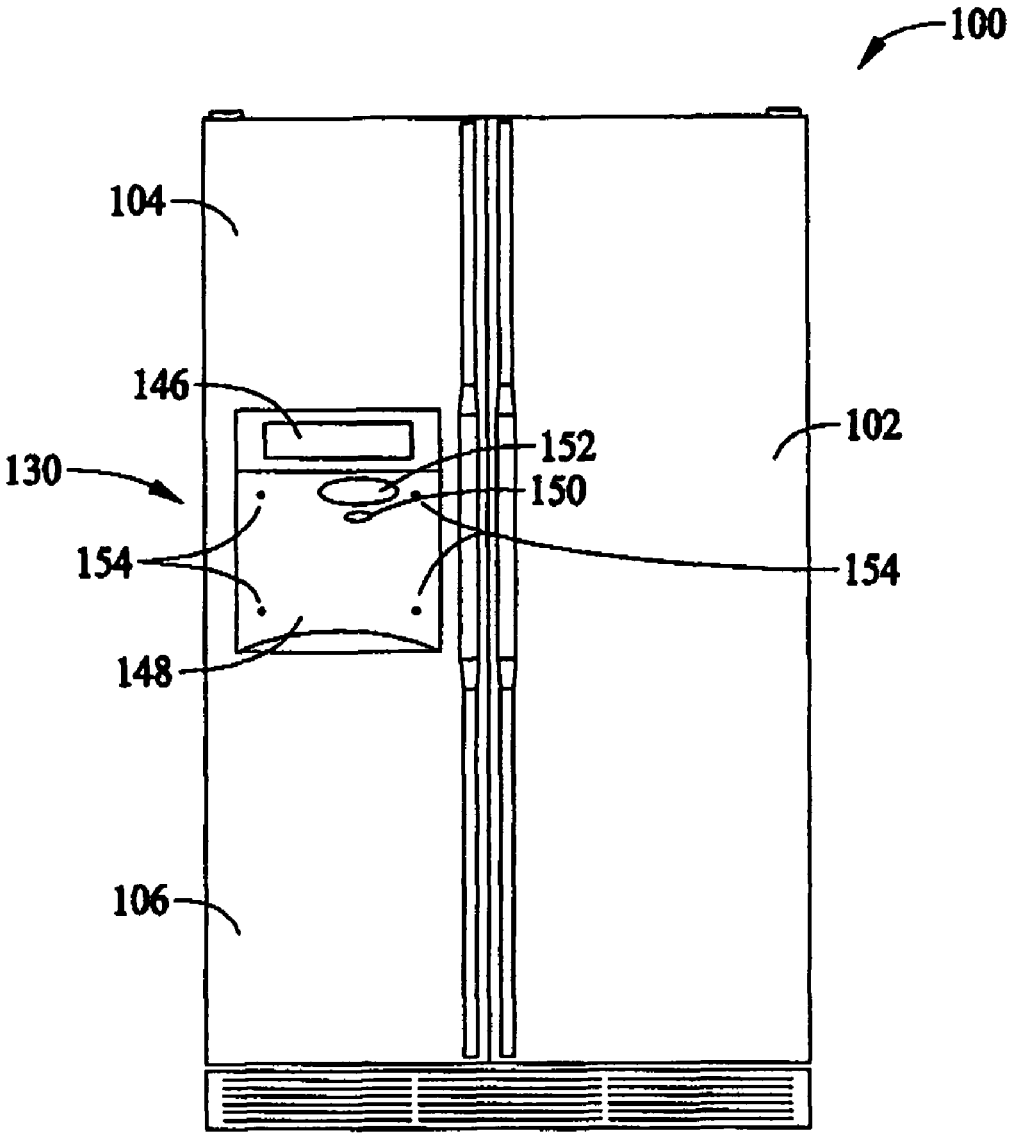
FIG. 2 is a front view of the refrigerator in FIG. 1.

FIG. 2 is a front view of refrigerator 100 with doors 102 and 104 in a closed position. Freezer door 104 includes water and ice dispenser 130 and a user interface 146. A dispenser cavity 148 includes a water conduit 150, an ice conduit 152, and, as explained in greater detail below, an optical system 154.

It is noted that exemplary freezer door panel 104 and water and ice conduits 150, 152 are intended for illustrative purposes only, and that that the herein described dispenser may be used with differently configured freezer doors and conduits than illustrated. It is further contemplated that dispenser 130, and supporting mechanisms (such as a light pipe, etc.), as explained further below, may be located elsewhere relative to cavity 148 of dispenser 130.

Figure 3:
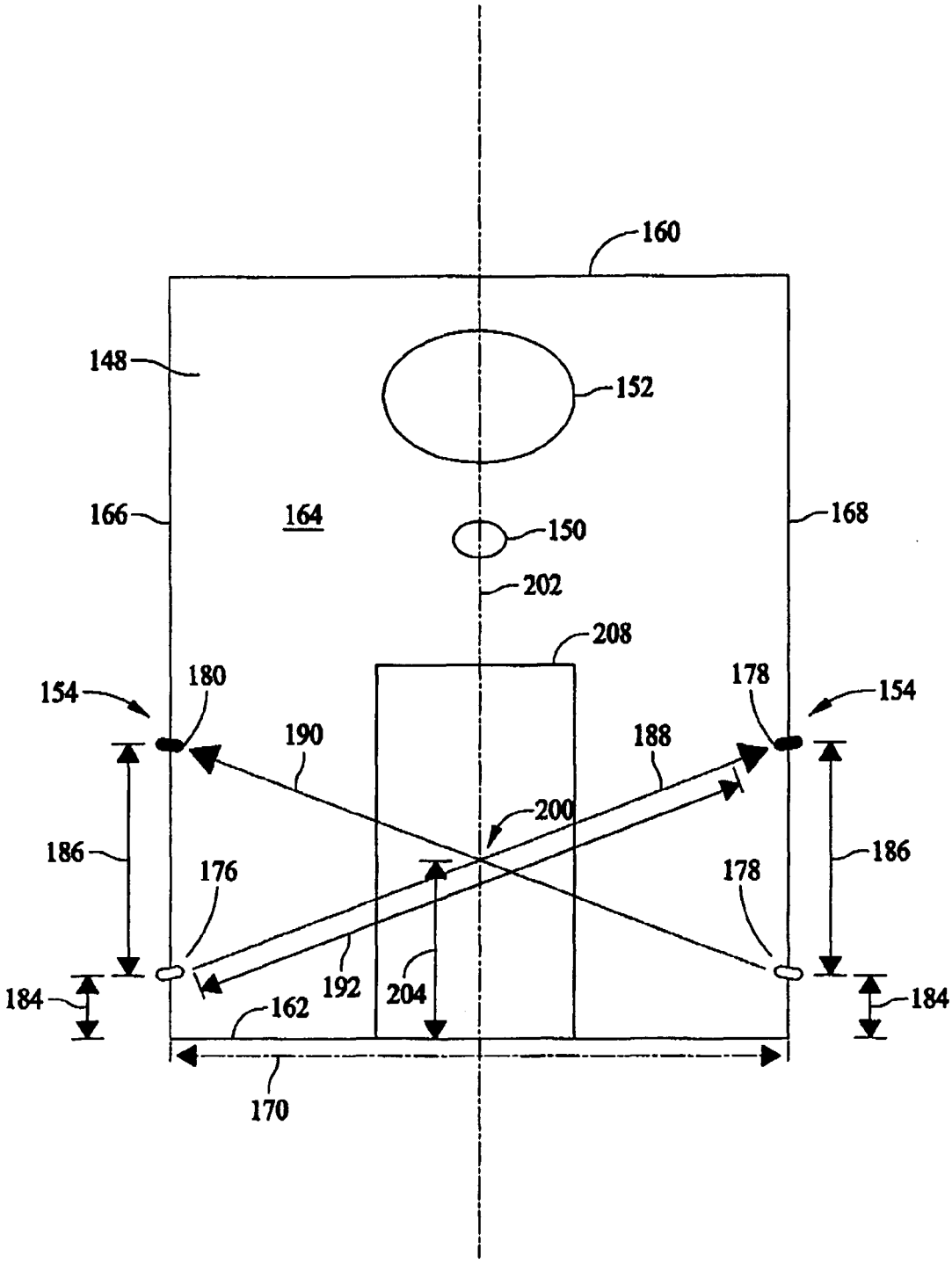
FIG. 3 is a front view of the dispenser in FIG. 2.
Figure 4:
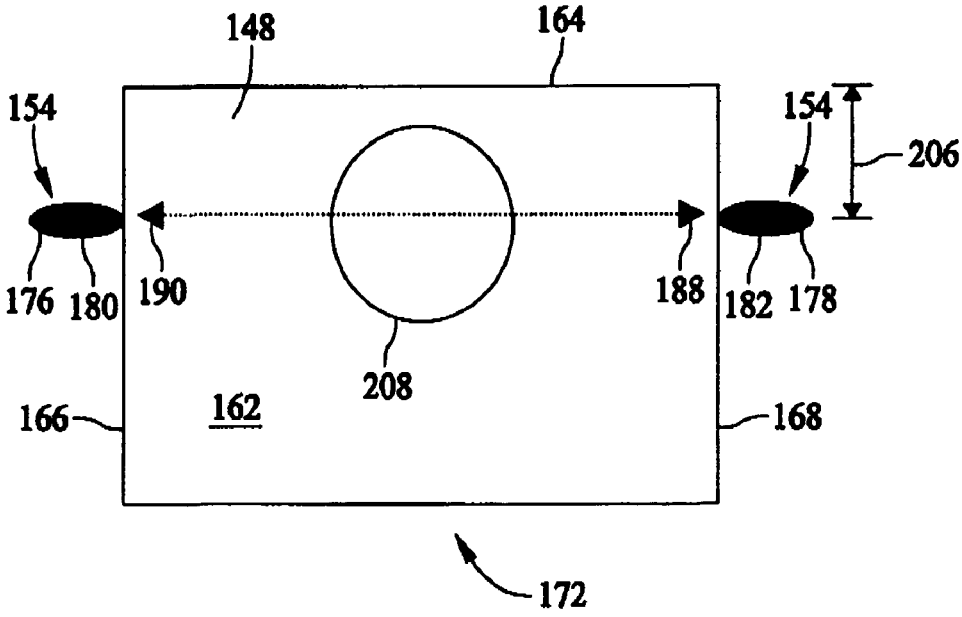
FIG. 4 is a top view of the dispenser in FIG. 3.

Referring to FIGS. 3 and 4, dispenser cavity 148 includes a top wall 160, a bottom wall 162, a back wall 164 and a pair of side walls 166, 168. Top and bottom walls 160, 162 are substantially parallel each other and substantially perpendicular to back wall 164 and each of side walls 166, 168. In the exemplary embodiment, side walls 166, 168 form right angle corners with back wall 164. In an alternative embodiment, side walls 166, 168 form arcuate corners with back wall 164. Side walls 166, 168 are spaced apart a distance 170. In the exemplary embodiment, distance 170 is 17.5 cm. In one embodiment, distance 170 is in a range of about 15.0 cm to about 20.0 cm.

Cavity 148 has an opening 172 defined by side walls 166, 168 and top and bottom walls 160, 162. In the exemplary embodiment, cavity 148 is unitary. In an alternative embodiment, cavity 148 is non-unitary. Cavity 148 is formed from a suitable resilient material, such as ABS.

Water conduit 150 is substantially circular and extends through back wall 164 to a water reservoir (not shown). Ice conduit 152 is substantially circular and extends through back wall 164 to ice bucket 131. In alternative embodiments, water and/or ice conduits 150, 152 extend through top wall 160.

Optical system 154 facilitates the dispensing of both water and ice to a user upon request. In general, light is used to sense the presence of a container 208 within cavity 148. System 154 includes a first light emitter assembly 176 positioned within side wall 166 and a second light emitter assembly 178 positioned within side wall 168. System 154 further includes a first light receiver assembly 180 positioned within side wall 166 and a second light receiver assembly 182 positioned within side wall 168. In the exemplary embodiment, each light emitter assembly 176, 178 includes an emitter printed circuit board (PCB) (not shown) configured to support an infrared (IR) light emitting diode (LED) 176, 178 and each light receiver assembly 180, 182 includes a receiver PCB (not shown) configured to support an IR photodetector or phototransistor 180, 182. In an alternative embodiment, IR LEDs 176, 178 and IR photodetectors 180, 182 are wired directly to their leads eliminating the need for emitter and PCBs, respectively. IR LEDs 176, 178 and IR photodetectors 180, 182 are known in the art and are therefore not further described.

It can be appreciated that optical system 154, shown in the form of two sensor pairs, can be any type of system which includes a source of optical energy and a detector of optical energy. Although a pair of LEDs and photodetectors are shown, there may be other types of optical elements which could be suitable for use herein. It can be further appreciated that each IR LED 176, 178 has associated with it or in some suitable place a microprocessor (not shown) and the necessary electronic circuitry (not shown) to operate optical system 154.

IR LED 176 is positioned diametrically opposed to IR photodetector 182 such that IR photodetector 182 can see IR LED 176 and a straight-line optical path 188 is defined therebetween. IR LED 178 is positioned diametrically opposed to IR photodetector 180 such that IR photodetector 180 can see IR LED 178 and a straight-line optical path 190 is defined therebetween. Each photodetector 180, 182 is oriented downward towards each IR LED 178, 176 respectively, such that ambient light from room light has a reduced effect. Further, each photodetector 180, 182 may be recessed to facilitate the reduction of dirt and particulates interfering with light emitted from IR LEDs 178, 176 respectively.

IR LEDs 176 and 178 are spaced a distance 184 from bottom wall 162. In the exemplary embodiment, distance 184 is 5.0 cm. In one embodiment, distance 184 is in a range of about 2.5 cm to about 7.5 cm. A distance 186 extends between IR LED 176 and IR photodetector 180, and IR LED 178 and IR photodetector 182, respectively. Distance 186 is spaced such that optical paths 188, 190 contact a container (not shown) at a shallow angle producing a greater attenuation. In the exemplary embodiment, distance 186 is 12.5 cm. In one embodiment, distance 186 is in a range of about 10.0 cm to about 15.0 cm. In the exemplary embodiment, shallow angle is 54.5 degrees. In one embodiment, shallow angle is in a range of about 45.0 degrees to about 63.4 degrees.

Optical paths 188, 190 have a length 192. In the exemplary embodiment, length 192 is 21.5 cm. In one embodiment, length 192 is in a range of about 18.0 cm to about 25.0 cm. Optical paths 188, 190 intersect at an intersection point 200. Intersection point 200 is located on a vertical center axis 202 and spaced a distance 204 from bottom wall 162. In the exemplary embodiment, distance 204 is 11.25 cm. In one embodiment, distance 204 is in a range of about 7.5 cm to about 15.0 cm. Additionally, water and ice conduits 150, 152 are centered on axis 202.

Referring specifically to FIG. 4, optical paths 188, 190 are in vertical alignment and spaced a distance 206 from back wall 164. In the exemplary embodiment, distance 206 is 1.5 cm. In one embodiment, length 206 is in a range of about 0.5 cm to about 4.0 cm. In an alternative embodiment, optical paths 188, 190 are not in vertical alignment.

Figure 5:
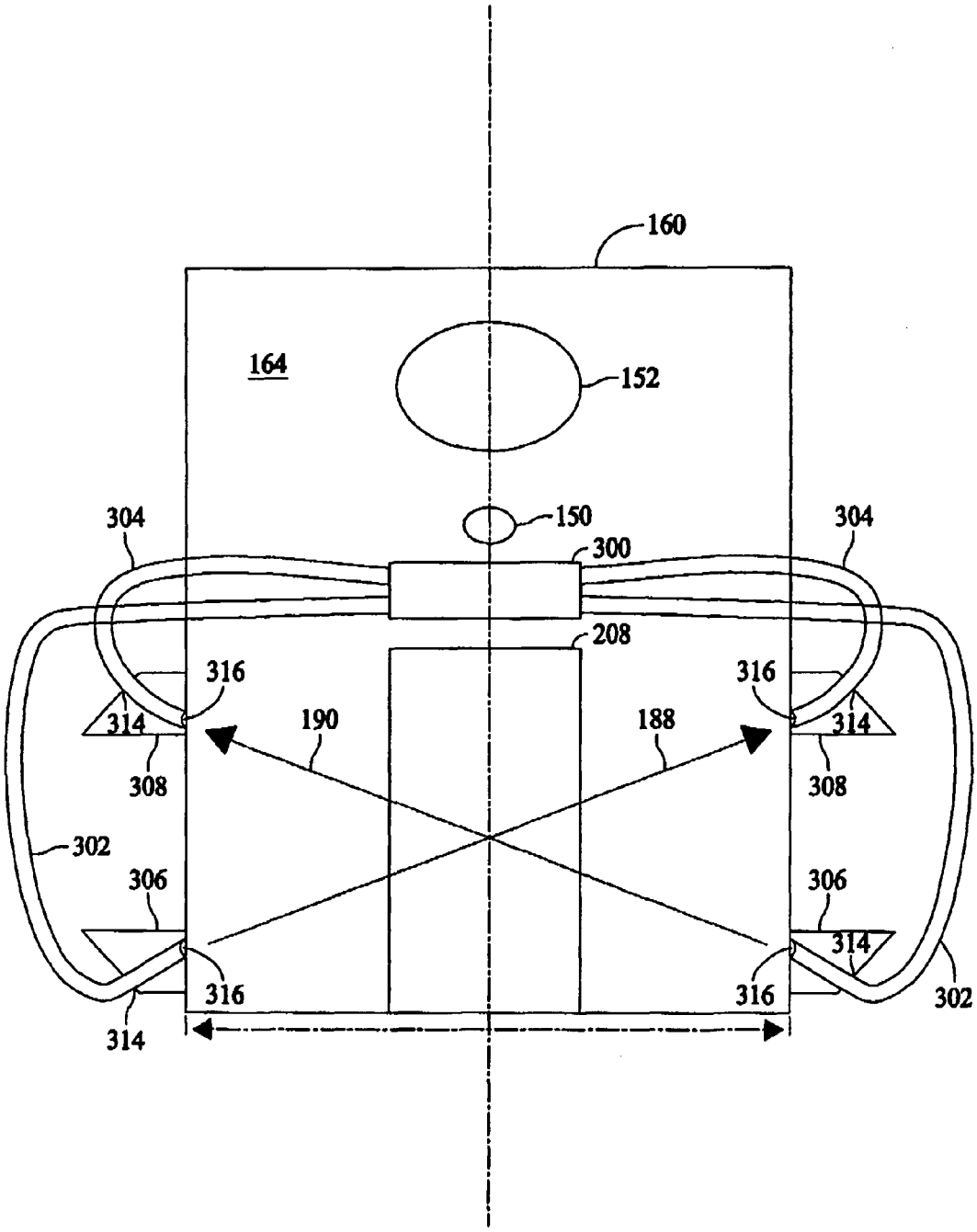
FIG. 5 is a front view of an alternative embodiment of the dispenser cavity in FIG. 3.
Figure 6:
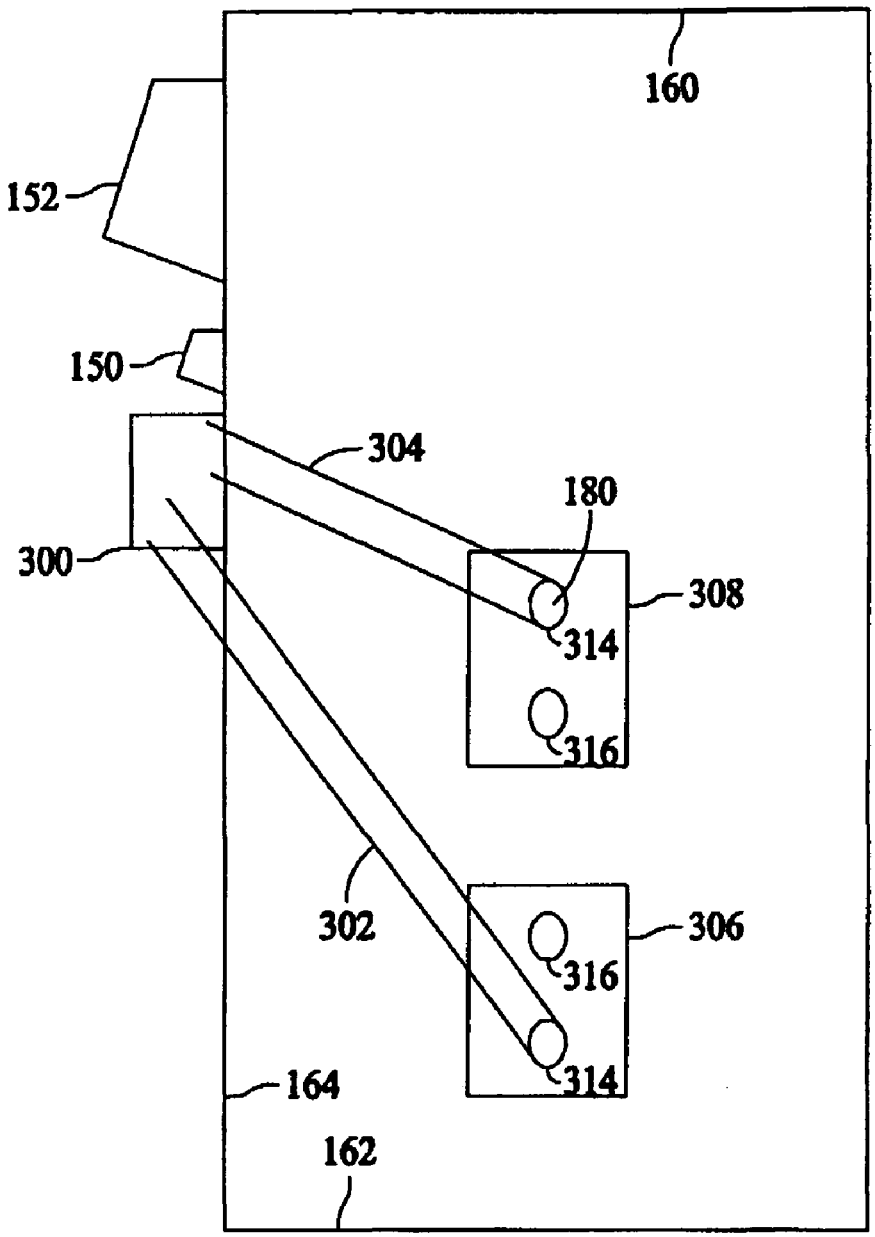
FIG. 6 is a side view of the alternative embodiment of the dispenser cavity in FIG. 5.

FIGS. 5 and 6 illustrate an alternative embodiment of optical system 154. Optical system includes a control board 300 coupled to a first pair of light emitting pipes 302 and a second pair of photodetector pipes 304. In the exemplary embodiment, control board 300 is positioned behind back wall 164. In another embodiment, control board 300 is positioned above top wall 160. Light emitting pipes 302 are configured to mount within recesses 306. Photodetector pipes 304 are configured to mount within recesses 308. Light pipes 302 facilitate orientation and alignment of IR light towards photodetectors pipes 304. Recesses 306, 308 include a mount aperture 314 and a cavity aperture 316 sized to accommodate each respective light pipe 302 and photodetector pipe 304 diameter. Recesses 306, 308 facilitate the reduction of dirt and particulates interfering with projection and/or detection of IR light. In one embodiment, mount aperture 314 is 3.18 mm and cavity aperture is 4.76 mm. In one embodiment, light emitting pipes 302 and photodetector pipes 304 are commercially available from Bivar Inc., Irvine, Calif., and are configured to be modified to incorporate the herein described methods and apparatus.

In use, dispenser 130 may be selectively controlled with the microprocessor according to user preference via user interface 146. IR radiation is generated by each LED 176, 178 which is directed along optical paths 188, 190 through cavity 148 to be received by each IR photodetector 182, 180, respectively. Dispenser 130 remains idle until user inserts container 208 into cavity 148. When the reception of the transmitted IR radiation is impeded or interrupted, dispenser 130 is actuated. In the exemplary embodiment, when the reception of IR photodetector 182 or 180 is impeded or interrupted dispenser 130 is actuated. In alternative embodiment, when the reception of IR photodetector 182 and 180 are impeded or interrupted dispenser 130 is actuated.

When the reception of the transmitted IR radiation is unimpeded or uninterrupted, dispenser 130 is deactivated. In the exemplary embodiment, when the reception of IR photodetector 182 and 180 are unimpeded or uninterrupted dispenser 130 is deactivated. In an alternative embodiment, when the reception of IR photodetector 182 or 180 is unimpeded or uninterrupted dispenser 130 is activated.

In one embodiment, IR LEDs 176, 178 are configured to pulse. In another embodiment, IR LEDs 176, 178 are configured to transmit IR radiation continuously. Frequency and duration of transmission, as well as, sensitivity to interruption may be controlled by the microprocessor.

While the invention has been described in terms of various specific embodiments, those skilled in the art will recognize that the invention can be practiced with modification within the spirit and scope of the claims.

What is claimed is:

1. A method for actuating a dispensing system, the system includes a dispenser cavity and a dispenser, said method comprising:

intersecting at least two beams of light, wherein intersecting the at least two beams of light comprises coupling a first infra-red (IR) light emitting diode (LED) element on a first wall of the cavity and coupling a second IR LED on a second wall of the cavity opposite the first wall;

sensing the at least two beams of light, wherein sensing the at least two beams of light comprises coupling a first IR photodetector on the first wall of the cavity and coupling a second IR photodetector on the second wall of the cavity, wherein each IR photodetector is positioned above each IR LED; and actuating the dispenser system based upon said sensing.

2. A method in accordance with claim 1 wherein intersecting at two beams of light comprises directing a first beam of light from the first IR LED towards the first IR photodetector and directing a second beam of light from the second IR LED towards the second IR photodetector such that the first and the second beam of light intersect at an intersection point.

3. A method in accordance with claim 1 wherein actuating the dispenser system comprises generating a first signal when at least one the first and second beams of light are impeded such that the dispenser system is actuated.

4. A method in accordance with claim 3 wherein actuating the dispenser system comprises generating a second signal when both the first and second beams of light are unimpeded such that the dispenser system is deactivated.

5. An optical system for a dispenser system comprising:

at least two light emitting optic elements mounted on opposing first and second dispenser walls; and at least two light receiving optic elements mounted on said opposing first and second dispenser walls, wherein each of said at least two light receiving optic elements is in optical communication with each of said at least two light emitting optic elements, wherein said at least two light receiving optic elements are in electromechanical communication with said dispenser system, said at least two light receiving optic elements are mounted above said at least two light emitting optic elements.

6. A system in accordance with claim 5, wherein said at least two light emitting optic elements are infra-red (IR) light emitting diodes (LED) and said at least two light receiving optic elements are IR photodetectors.

7. A system in accordance with claim 5, wherein said at least two light receiving optic elements are in vertical alignment with said at least two light emitting optic elements.

8. A system in accordance with claim 5, wherein said at least two light receiving optic elements cooperate with said at least two light emitting optic elements such that a first optical path and a second optical path are generated.

9. A system in accordance with claim 8, wherein said first optical path and said second optical path intersect at an intersection point.

10. A system in accordance with claim 8, wherein said at least two light receiving optic elements generate a signal to said dispenser if at least one of said first optical path and said second optical path are impeded.

11. A dispenser system comprising:

a top wall, a bottom wall, and a cavity extending therebetween, said top wall parallel said bottom wall;

a first wall, a second wall, and a third wall positioned therebetween, said second wall opposite said first wall, said third wall substantially perpendicular to both said first and second walls, said first, second, and third walls substantially perpendicular to both said top wall and said bottom wall;

at least one dispenser coupled to said third wall; and an optical system coupled to said first and said second wall and in electromechanical communication with said at least one dispenser, said optical system comprising at least two light receiving elements mounted above at least two light emitting optic elements.

12. A system in accordance with claim 11, wherein said optical system at least two light receiving optic elements and at least two light emitting optic elements further comprises:

a first light emitting optic element coupled to said first wall and a second light emitting optic element coupled to said second wall; and a first light receiving optic element coupled to said second wall and a second light receiving optic element mounted on said first wall, wherein said first light emitting optic element is in optical communication with said first light receiving optic element and said second light emitting optic element is in optical communication with said second light receiving optic element such that a first optical path and a second optical path are generated.

13. A system in accordance with claim 12, wherein said first and second light emitting optic elements are infra-red (IR) light emitting diodes (LED) and said first and second light receiving optic elements are IR photodetectors.

14. A system in accordance with claim 12, wherein said optical system is configured to actuate said at least one dispenser when a container within said cavity impedes both said first and second optical paths.

15. A system in accordance with claim 11, wherein said optical system is configured to actuate said at least one dispenser when a container is sensed within said dispenser cavity.

16. A system in accordance with claim 11, wherein said dispenser is configured to mount within a refrigerator, an ice machine, and a beverage dispenser.

* * * * *